US008893639B1

(12) United States Patent
Crate et al.

(10) Patent No.: US 8,893,639 B1
(45) Date of Patent: Nov. 25, 2014

(54) ACCESSORY ATTACHMENT SYSTEM FOR A MARINE OUTBOARD ENGINE

(71) Applicant: BRP US Inc., Sturtevant, WI (US)

(72) Inventors: Nicholas Crate, Palm Beach, FL (US); Paul Westhoff, Jr., Kenosha, WI (US); Mark Noble, Pleasant Prairie, WI (US); Todd Craft, Pleasant Prairie, WI (US)

(73) Assignee: BRP US Inc., Sturtevant, WI (US)

( * ) Notice: Subject to any disclaimer, the term of this patent is extended or adjusted under 35 U.S.C. 154(b) by 4 days.

(21) Appl. No.: 13/755,591

(22) Filed: Jan. 31, 2013

(51) Int. Cl.
*B63B 1/24* (2006.01)
*B63H 20/00* (2006.01)

(52) U.S. Cl.
CPC ..... *B63H 20/00* (2013.01)
USPC ..... 114/274

(58) Field of Classification Search
USPC ..... 114/274
IPC ..... B63B 1/24,1/242
See application file for complete search history.

(56) References Cited

U.S. PATENT DOCUMENTS

| | | | | |
|---|---|---|---|---|
| 1,576,237 | A | | 3/1926 | Dawson |
| 2,564,903 | A | | 8/1951 | Irgens |
| 3,980,035 | A | | 9/1976 | Johansson |
| 4,205,618 | A | | 6/1980 | Olsson |
| 4,352,666 | A | | 10/1982 | McGowan |
| 4,355,985 | A | | 10/1982 | Borst et al. |
| 4,500,298 | A | | 2/1985 | Hall et al. |
| 4,708,672 | A | | 11/1987 | Bentz et al. |
| 4,781,632 | A | | 11/1988 | Litjens et al. |
| 4,787,867 | A | | 11/1988 | Takeuchi et al. |
| 4,968,275 | A | * | 11/1990 | Carlson ..... 440/66 |
| 4,995,840 | A | | 2/1991 | Seale et al. |
| 5,107,786 | A | | 4/1992 | Templeman |
| 5,127,353 | A | | 7/1992 | Wieser |
| 5,138,966 | A | | 8/1992 | Whitley, II |
| 5,178,089 | A | | 1/1993 | Hodel |
| 5,203,275 | A | | 4/1993 | Brauner et al. |
| 5,305,701 | A | | 4/1994 | Wilson |

(Continued)

FOREIGN PATENT DOCUMENTS

| | | |
|---|---|---|
| JP | 56160297 | 12/1981 |
| JP | 4092797 | 3/1992 |

OTHER PUBLICATIONS

English Abstract of JP56160297, Published Dec. 9, 1981; Retrieved from http://worldwide.espacenet.com on May 22, 2013.

(Continued)

*Primary Examiner* — Stephen Avila
(74) *Attorney, Agent, or Firm* — BCF LLP

(57) ABSTRACT

A drive unit has an engine, an operatively connected driveshaft, a transmission, and a propeller shaft connected to a rotor outside a gear case. A plate, extending above the rotor, is adapted to slidingly receive along a joint axis, an accessory having an accessory joint element which is one of a channel and a protrusion. Extending parallel to the joint axis along a plate joint surface, which is one of a first surface facing away from the rotor and a second surface facing toward the rotor, is a plate joint element, which is the other of the channel and the protrusion, adapted to slidingly interlock with the accessory joint element to thereby prevent displacement thereof in a first direction parallel to the plate joint surface and perpendicular to the joint axis, and in a second direction normal to the plate joint surface. An accessory attachment method is also disclosed.

22 Claims, 11 Drawing Sheets

(56) References Cited

U.S. PATENT DOCUMENTS

| | | | | |
|---|---|---|---|---|
| 5,307,754 | A | 5/1994 | Leonardis | |
| D351,129 | S | 10/1994 | Templeman | |
| 5,421,279 | A | 6/1995 | Louks et al. | |
| 5,638,765 | A * | 6/1997 | Poulos | 114/274 |
| 6,397,772 | B1 | 6/2002 | Christensen | |
| D590,760 | S | 4/2009 | Templeman et al. | |
| 7,594,834 | B2 | 9/2009 | Shiomi et al. | |
| D615,475 | S | 5/2010 | Corn | |
| 7,987,804 | B2 | 8/2011 | Shiomi et al. | |
| 2009/0314195 | A1 * | 12/2009 | Templeman et al. | 114/274 |

OTHER PUBLICATIONS

English Abstract of JP0492797, Published Mar. 25, 1992; Retrieved from http://worldwide.espacenet.com on May 22, 2013.

* cited by examiner

ACCESSORY ATTACHMENT SYSTEM FOR A MARINE OUTBOARD ENGINE

FIELD OF THE INVENTION

The present invention relates generally to marine outboard engines, and more specifically, to accessory attachment systems for marine outboard engines.

BACKGROUND

The gearcase of an outboard engine of a boat is often provided with an anti-ventilation (AV) plate, which is also sometimes referred to as an anti-cavitation plate or a cavitation plate. The AV plate, which extends horizontally and rearward from the gearcase above the propeller, is intended to prevent surface air from being sucked down into the rotating propeller. The AV plate can also provide some measure of splash protection to the engine extending thereabove and the interior of the boat against the water being sprayed by the rotating propeller. Additional flanges extending rearwards from the gearcase or the midsection of the engine may also be provided.

It is known to adapt the AV plate to other functions by either modifying the plate itself or by attaching hydrodynamic elements to/near the AV plate. For example, U.S. Pat. No. 2,564,903, issued Aug. 21, 1951 to Irgens, describes an AV plate that doubles as a trim tab having angled surfaces to provide lift. Other examples of hydrodynamic elements that have been provided on or near an AV plate include hydrofoil wings of various kinds for generating lift, pivotable fins to compensate for torque created by the propeller, and trolling plates.

These structures are typically attached to the AV plate by bolts extending vertically through the horizontally extending AV plate. The installation of the structures on the AV plate may require access to the space between the AV plate and the propeller, and the structures may also need to be held to the AV plate by other means while they are being positioned thereon and fastened thereto.

It is desirable to have a quick, easy and reliable attachment system for installation of hydrodynamic structures and other accessories on an outboard engine. It is also desirable to have an attachment system that is versatile and able to receive different kinds of accessories.

SUMMARY

It is an object of the present invention to ameliorate at least some of the inconveniences present in the prior art.

In one aspect, the present provides a drive unit including an engine and a driveshaft having a first end and a second end. The first end of the driveshaft is operatively connected to the engine. A transmission is operatively connected to the second end of the driveshaft. The drive unit includes a gearcase. A propeller shaft is disposed at least in part in the gear case at an angle to the driveshaft. The propeller shaft is operatively connected to the transmission. A bladed rotor is connected to the propeller shaft and extends outside the gear case. A plate extends above the rotor. The plate is adapted to slidingly receive an accessory along a joint axis. The accessory has an accessory joint element. The accessory joint element is one of a channel and a protrusion. The plate includes a first surface facing away from the rotor, and a second surface facing toward the rotor. One of the first and second surfaces is a plate joint surface. A plate joint element is the other of the channel and the protrusion. The plate joint element extends along the plate joint surface parallel to the joint axis. The plate joint element is adapted to slidingly interlock with the accessory joint element to thereby prevent displacement of the accessory joint element in a first direction parallel to the plate joint surface and perpendicular to the joint axis, and in a second direction normal to the plate joint surface.

In another aspect, the joint axis is normal to a plane containing the rotational axis of the rotor and the driveshaft.

In yet another aspect, the joint surface is the second surface facing toward the rotor.

In an additional aspect, the plate includes a rear edge disposed opposite the one of the midsection and the gear case, a first lateral edge and a second lateral edge. Each lateral edge extends between the rear edge and the one of the midsection and the gear case. The plate joint element extends from the first lateral edge to the second lateral edge.

In a further aspect, the plate joint element includes at least one channel extending into the plate from the joint surface. Each of the at least one channel is defined by a pair of opposing side walls and a base connecting the opposing side walls. Each of the opposing side walls extends from the joint surface, at an acute angle with respect thereto, towards the channel base.

In another aspect, the plate includes a fastener aperture having a fastener axis parallel to the joint axis. The fastener aperture is adapted to receive a fastener to prevent displacement of the accessory joint surface in the direction parallel to the joint axis when the accessory is slidably received on the plate.

In another aspect, the drive unit includes an accessory having an accessory joint surface with the accessory joint element. The accessory joint element is interlocked with the plate joint element. A fastener fastens the accessory to the plate and thereby prevents displacement of the accessory joint element in the direction parallel to the joint axis.

In yet another aspect, the fastener is one of a screw and a bolt, the one of the screw and the bolt extending parallel to the joint axis.

In another aspect, the accessory further includes an accessory surface generally facing the rotor and extending at a lift angle with respect to the plate joint surface to generate lift when submerged in water.

In a further aspect, the accessory surface is curved.

In another aspect, the lift angle of the accessory surface is adjustable.

In yet another aspect, the accessory further includes a hinge. The accessory surface is disposed in a portion of the accessory pivotably connected, by the hinge, to a portion of the accessory having the accessory joint surface. The lift angle of the accessory surface is thereby adjustable.

In an additional aspect, the accessory also includes an actuator. The accessory surface is disposed in a portion of the accessory connected to the actuator, the lift angle of the accessory surface being thereby adjustable by the actuator.

In another aspect, the lift angle of the accessory surface is adjustable in response to the hydrodynamic force of the water.

In a further aspect, the accessory is elastically deformable so as to adjust the lift angle in response to the hydrodynamic force of the water.

In an additional aspect, the accessory has a spring. The accessory surface biseing disposed in a portion of the accessory connected to a portion of the accessory having the accessory joint surface via the spring. The spring is compressible in response to the hydrodynamic force of the water to thereby adjust the lift angle in response to the hydrodynamic force of the water.

In another aspect, the plate joint element is a plurality of the one of the channel and the protrusion.

In yet another aspect, the accessory has an accessory body defined by a first accessory portion and a second accessory portion. The first accessory portion is adjacent to the second accessory portion, and each of the first and second accessory portions includes at least a portion of the accessory joint element interlocked with the plate joint element.

In an additional aspect, the first and second accessory portions are each adapted to be slidingly received on the plate from opposite directions parallel to the joint axis.

In a further aspect, the accessory body has an accessory surface generally facing the rotor. The accessory surface is continuous across a boundary between the adjacent first and second accessory portions. The accessory surface extends at a lift angle with respect to the accessory joint surface to generate lift.

In another aspect, the fastener extends from one of the first accessory portion and the second accessory portion to the other of the first accessory portion and the second accessory portion to prevent displacement of the accessory joint.

In another aspect, the drive unit also includes a cowling. The engine and the driveshaft are disposed in the cowling. A midsection is connected to the engine. The midsection has a first end and a second end. The gearcase is connected to the second end of the midsection. The plate extends from one of the midsection and the gearcase.

In another aspect, the present provides a method of attaching an accessory to a plate of a drive unit. The plate extends above a propeller of the drive unit. The method includes sliding the accessory in a first direction along a surface of the plate to interlock one of a channel and a protrusion of the accessory with the other of the channel and the protrusion on the surface of the plate. A fastener is inserted into the accessory along a direction parallel to the first direction to lock the accessory to the plate.

For purposes of the present application, terms related to spatial orientation when referring to a marine outboard engine and components in relation to the marine outboard engine, such as "forwardly", "rearwardly", "left", "right", "above" and "below", are as they would be understood by a driver of a boat to which the marine outboard engine is connected, with the marine outboard engine connected to the stern of the boat, in a straight ahead orientation (i.e. not steered left or right), and in an upright position (i.e. not tilted and not trimmed).

Embodiments of the present invention each have at least one of the above-mentioned object and/or aspects, but do not necessarily have all of them. It should be understood that some aspects of the present invention that have resulted from attempting to attain the above-mentioned object may not satisfy this object and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION

The description will refer to attachment systems for a marine outboard engine. However, it is contemplated that some aspects of the attachment systems could be adapted for use on a stern drive.

Figure 1:
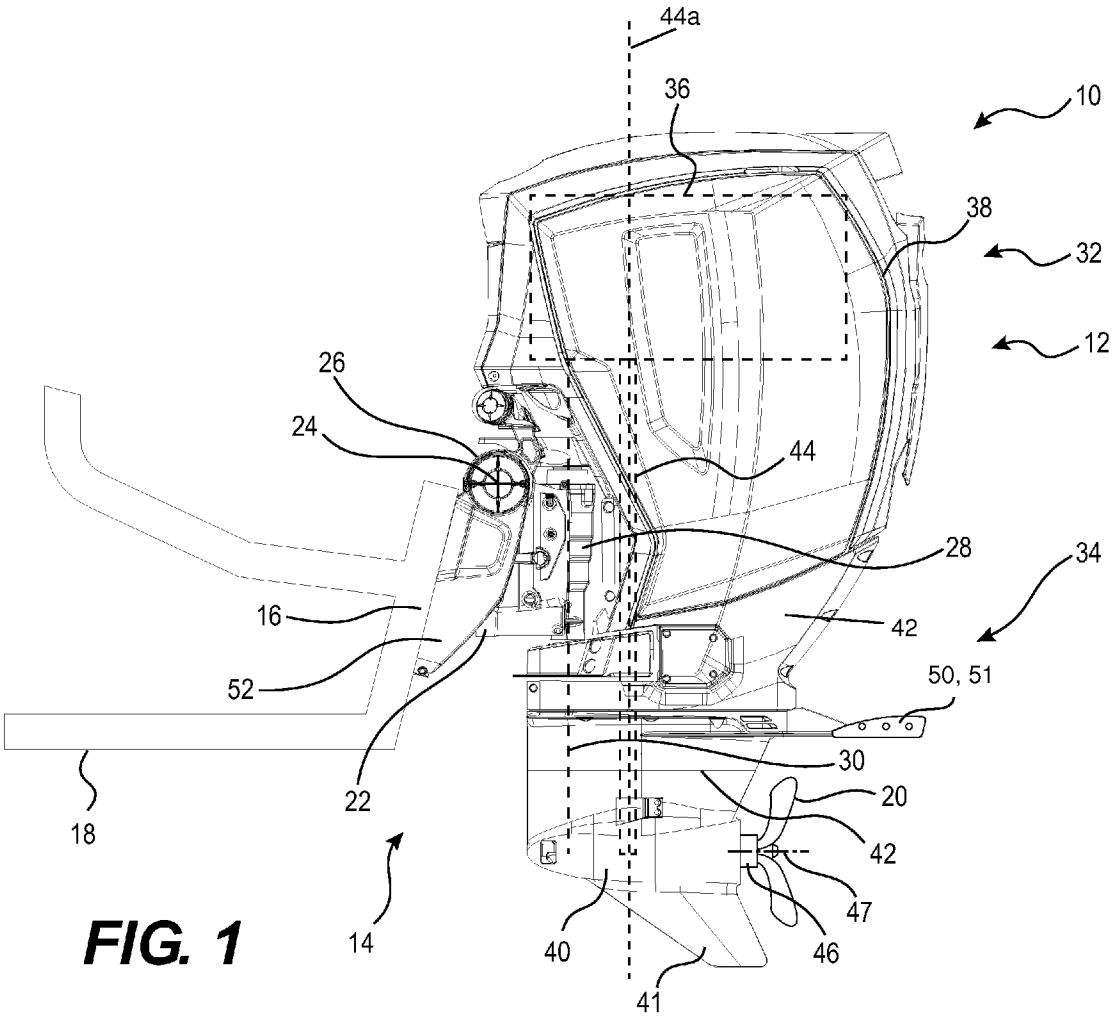
FIG. 1 is a left side elevation view of a marine outboard engine mounted to a stern of a boat.
Figure 2:
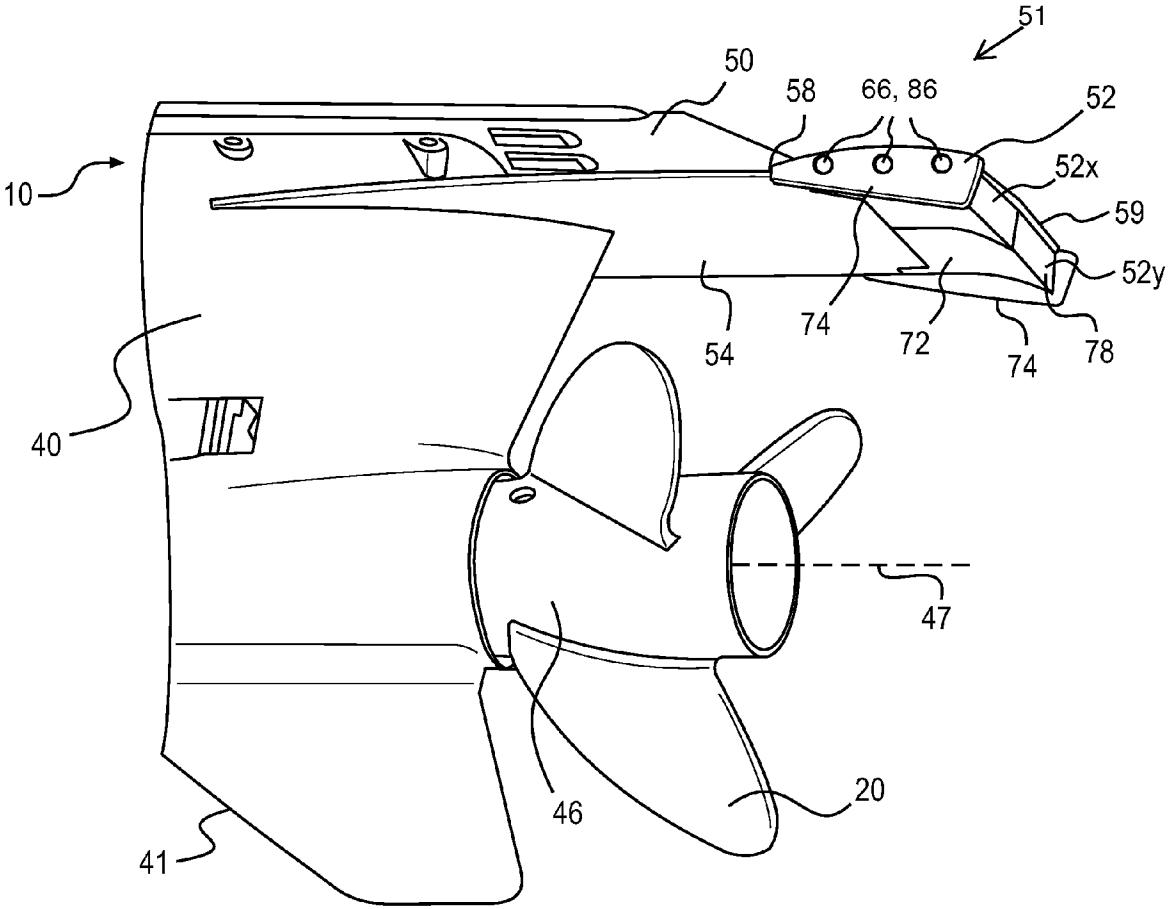
FIG. 2 is a perspective view, taken from a bottom, left side, of a rear portion of the marine outboard engine of FIG. 1, showing an anti-ventilation (AV) plate and a hydrodynamic foil as assembled on the AV plate and with the foil having a left foil portion and a right foil portion.
Figure 3:
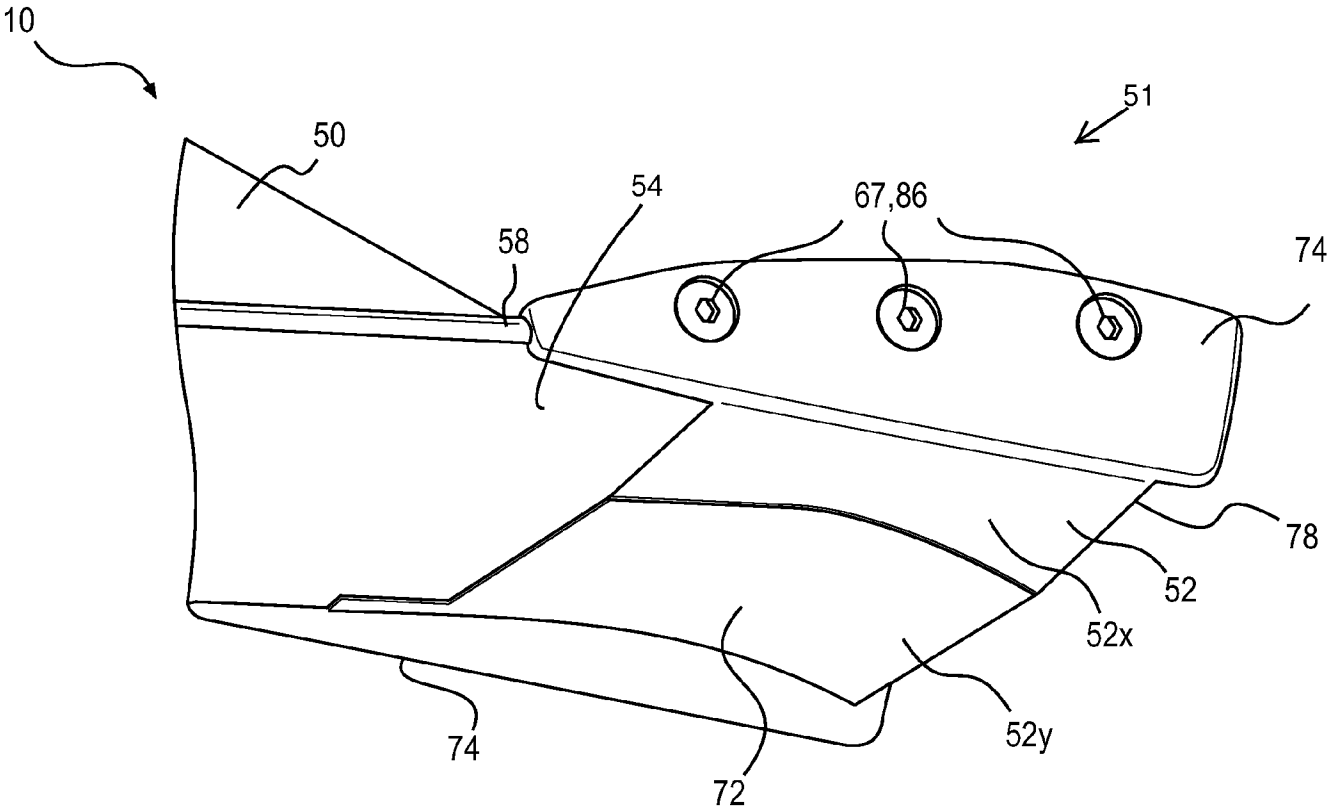
FIG. 3 is a close-up perspective view, taken from a bottom, left side, of the AV plate and foil of FIG. 2.

With reference to FIG. 1, a marine outboard engine 10, shown in the upright position, includes a drive unit 12 and a bracket assembly 14. The bracket assembly 14 supports the drive unit 12 on a transom 16 of a hull 18 of an associated watercraft such that a propeller 20 is in a submerged position with the watercraft resting relative to a surface of a body of water.

The drive unit 12 can be trimmed up or down relative to the hull 18 by linear actuators 22 of the bracket assembly 14 about a tilt/trim axis 24 extending generally horizontally. The drive unit 12 can also be tilted up or down relative to the hull 18 by a rotary actuator 26 of the bracket assembly 14 about the tilt/trim axis 24. The drive unit 12 can also be steered left or right relative to the hull 18 by another rotary actuator 28 of the bracket assembly 14 about a steering axis 30. The steering axis 30 extends generally perpendicularly to the tilt/trim axis 24. When the drive unit 12 is in the upright position as shown in FIG. 1, the steering axis 30 extends generally vertically. The actuators 22, 26 and 28 are hydraulic actuators.

The drive unit 12 includes an upper portion 32 and a lower portion 34. The upper portion 32 includes an engine 36 (schematically shown in dotted lines) surrounded and protected by a cowling 38. The engine 36 housed within the cowling 38 is an internal combustion engine, such as a two-stroke or four-stroke engine, having cylinders extending generally horizontally when the drive unit 12 is in an upright position as shown.

It is contemplated that other types of engines could be used and that the cylinders could be oriented differently. The lower portion 34 includes the gear case assembly 40, which includes the propeller 20, and the skeg portion 41. A midsection 42 is connected between the engine 36 and the gear case 40. It is contemplated that the midsection 42 could house a portion of an exhaust system of the outboard engine 10.

The engine 36 is coupled to a driveshaft 44 (schematically shown in dotted lines). The driveshaft 44 defines a driveshaft axis 44*a*. When the drive unit 12 is in the upright position, the driveshaft 44 is oriented vertically. It is contemplated that the driveshaft 44 could be oriented differently relative to the engine 34. The driveshaft 44 is disposed in the cowling 38, passes through the midsection 42 and is coupled to a drive mechanism (not shown), which includes a transmission (not shown) and the propeller 20, in the form of a bladed rotor, mounted on a propeller shaft 46. It is contemplated that the driveshaft 44 could not pass through the midsection 42. In FIG. 1, the propeller shaft 46 and therefore the rotation axis 47 of the propeller 20 is perpendicular to the driveshaft 44, however it is contemplated that it could be at other angles. The driveshaft 44 and the transmission transfer the power of the engine 36 to the propeller 20 mounted on the rear side of the gear case assembly 40 of the drive unit 12. It is contemplated that the propulsion system of the outboard engine 10 could alternatively include a jet propulsion device, turbine or other known propelling device. It is further contemplated that the bladed rotor could alternatively be an impeller.

For the purposes of the description below, the driveshaft axis 44*a* as disposed in FIG. 1, defines a vertical direction, such that the engine 36 disposed at a higher vertical position relative to the skeg 41. Furthermore, the longitudinal direction is defined by the propeller axis 47 in the configuration shown FIG. 1 such that the gearcase 40 is disposed rearward of the transom 16.

An anti-ventilation plate 50 (referred to hereinafter as the "AV plate" 50), supported by the gearcase 40 below the mid-section 42, extends rearwardly therefrom. The AV plate 50 extends horizontally above the propeller 20 and the propeller shaft 46. It is contemplated that the AV plate 50 could extend rearwards from the gearcase 40 or from the mid-section 42. The rear end of the AV plate 50 extends further rearwards than the propeller 20 in the longitudinal direction. The AV plate 50 is provided to prevent air above the water surface from being drawn down towards the rotating propeller 20. The AV plate 50 can acts as a splash-guard against water being sprayed upwards by the rotating propeller 20.

An accessory 52 is attached to the rear portion of the AV plate 50. More specifically, the accessory 52 shown in FIG. 1 is a hydrodynamic foil 52, also referred to as a hydrofoil. The surface 72 of the hydrodynamic foil 52 facing the propeller 20 is angled with respect to the horizontally-extending underside of the AV plate 50, and more particularly it is curved. The surface 72 provides lift to the stern of the watercraft which can aid the watercraft in reaching an on-plane condition after start-up of the engine 10. As such, the foil 52 can be considered a trim tab. The foil 52 can also help to prevent porpoising. The AV plate 50 and the hydrodynamic foil 52 will be described in further detail below.

Other known components of an engine assembly are included within the cowling 38, such as a starter motor, an alternator and the exhaust system. As it is believed that these components would be readily recognized by one of ordinary skill in the art, further explanation and description of these components will not be provided herein.

Turning now to FIGS. 2 to 6, the AV plate 50 and the hydrodynamic foil 52 attached thereto will be described. The foil 52 is attached to the AV plate 50 by an accessory attachment system 51 comprising an interlocking dovetail joint formed by interlocking complementary channels 62 (also referred to as pins) and protrusions 84 (also referred to as tails) formed respectively on the AV plate 50 and foil 52.

Although, the accessory attachment system 51 is described herein with respect to a dovetail joint formed between complementary dovetail joint elements 62, 84, namely the pins 62 and the tails 84, of the AV plate 50 and the hydrodynamic foil 52, it is contemplated that the other types of complementary channels 62 and protrusions 84 capable of slidably interlocking with each other can be used to form a joint between the AV plate 50 and the hydrodynamic foil 52. The term "dovetail joint" is used to refer to an interlocking joint between complementary pin-shaped protrusions and tail-shaped channels, as will be understood by a worker skilled in the art. It will also be understood that the joint can also be formed between a plate of the engine 10, other than the AV plate 50, and/or any accessory attachable thereto, in addition to the hydrodynamic foil 52.

Therefore, as used herein, a joint element is defined as an element that is capable of interlocking with a complementary joint element to form an interlocking joint. Channels 62 and protrusions 84 are generally referred to as joint elements. Pins and tails are generally referred to as dovetail joint elements. A joint element defined on an accessory, such as the foil 52, is referred to as an accessory joint element. A joint element extending on a plate of the outboard engine 10, such as the AV plate 50, is referred to as a plate joint element.

A surface having defined thereon a joint element is defined as a joint surface. A joint surface could include one or more joint elements, with each joint element being either a channel or a protrusion. A surface of an accessory having a joint element is referred to as an accessory joint surface. A surface of a plate having a joint element is referred to as a plate joint surface. Therefore, an accessory joint surface having accessory joint elements forms an interlocking joint with a plate joint surface having plate joint elements that are complementary to the accessory joint elements.

The AV plate 50 has a lower surface 54 facing towards the propeller 20, and an upper surface 56 facing away from the propeller 20. The rear portion of the AV plate 50 is generally rectangular, extending between lateral faces 58 and a rear face 59. The width of the AV plate 50 between the lateral faces 58 is approximately the same as the diameter of the propeller 20. The upper surface 56 is planar in the rear portion of the AV plate 50 while the lower surface 54 has the channels 62 defined thereon. The plate joint elements in this case are therefore channels 62. The lower surface 54, which is therefore the joint surface of the AV plate 50, forms a dovetail joint with complementary protrusions 84 of the accessory surface.

It is contemplated that the AV plate 50 could have a different shape than as shown. For example, the AV plate 50 could be oblong instead of rectangular, or the upper surface 56 could not be planar and have projections extending upwards therefrom.

Figure 4:
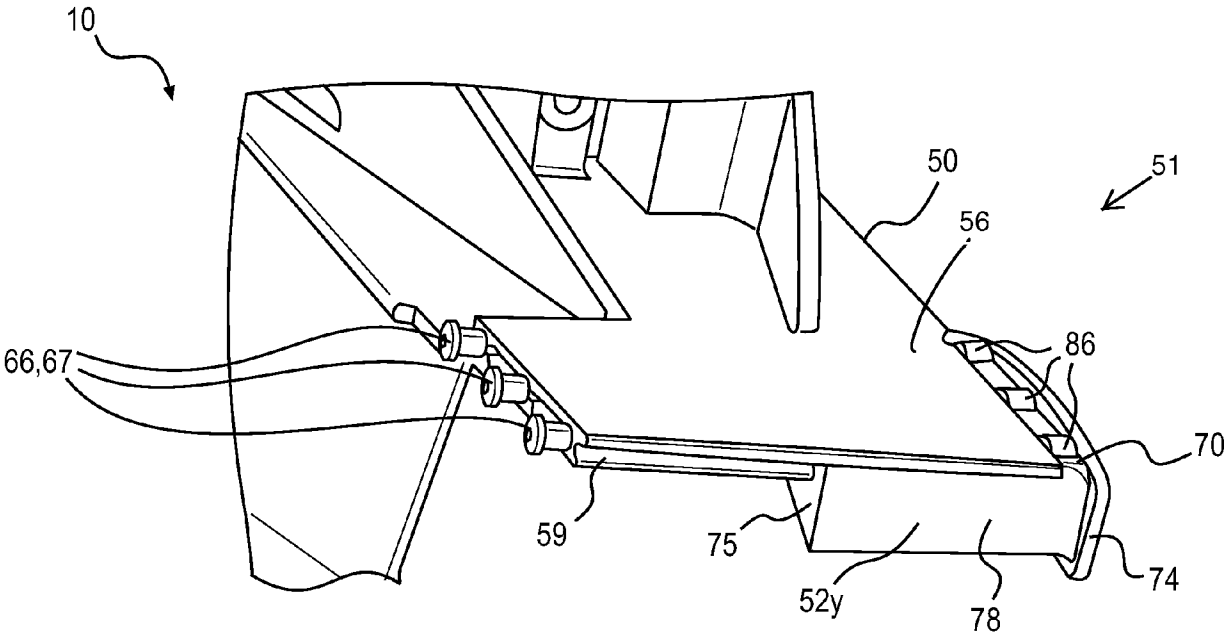
FIG. 4 is a perspective view, taken from a top, rear, left side, of a rear portion of FIG. 2, with the AV plate and the right foil portion installed thereon.
Figure 5:
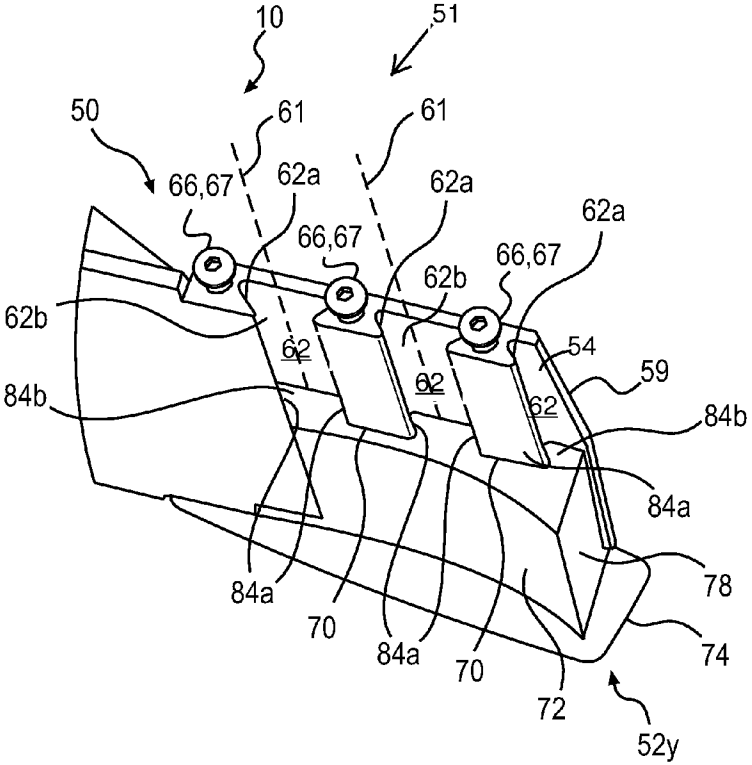
FIG. 5 is a perspective view, taken from a bottom, left side of the AV plate and right foil portion of FIG. 4.
Figure 7:
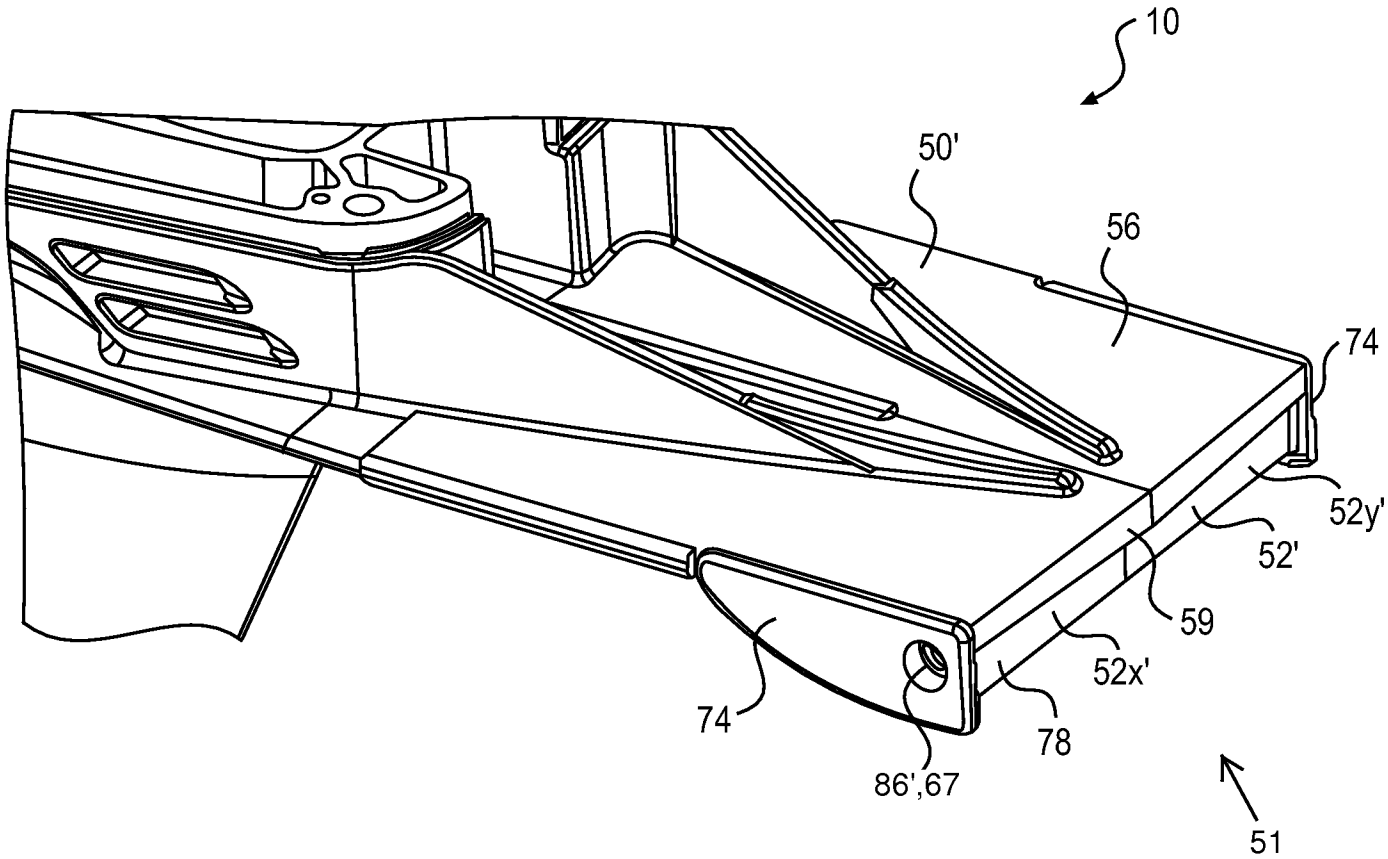
FIG. 7 is a perspective view, taken from a top, rear and left side, of a rear portion of the marine outboard engine of FIG. 1, having an AV plate and a foil according to another embodiment, with the foil having a left foil portion and a right foil portion installed on the AV plate.
Figure 8:
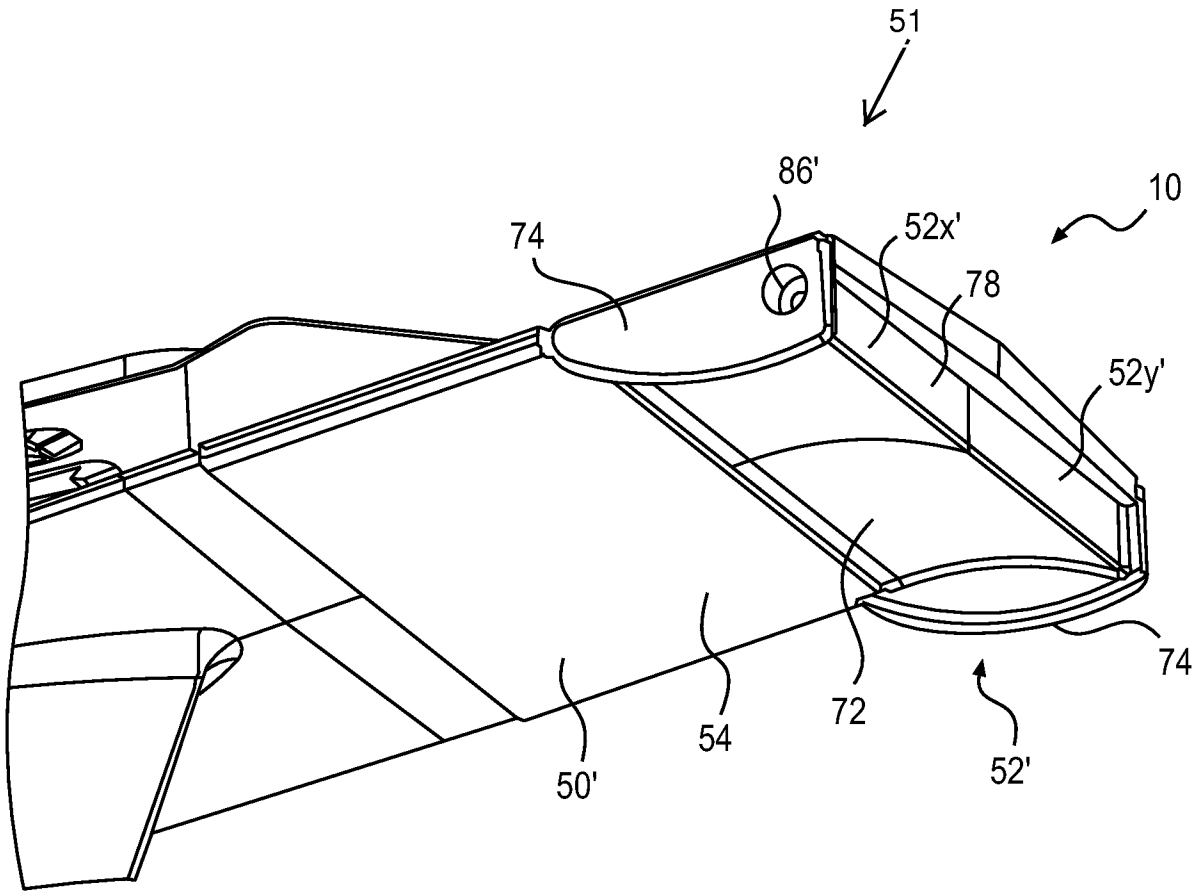
FIG. 8 is a perspective view, taken from a bottom, rear and left side, of the rear portion of the marine outboard engine of FIG. 7 with the AV plate and foil of FIG. 7.
Figure 9:
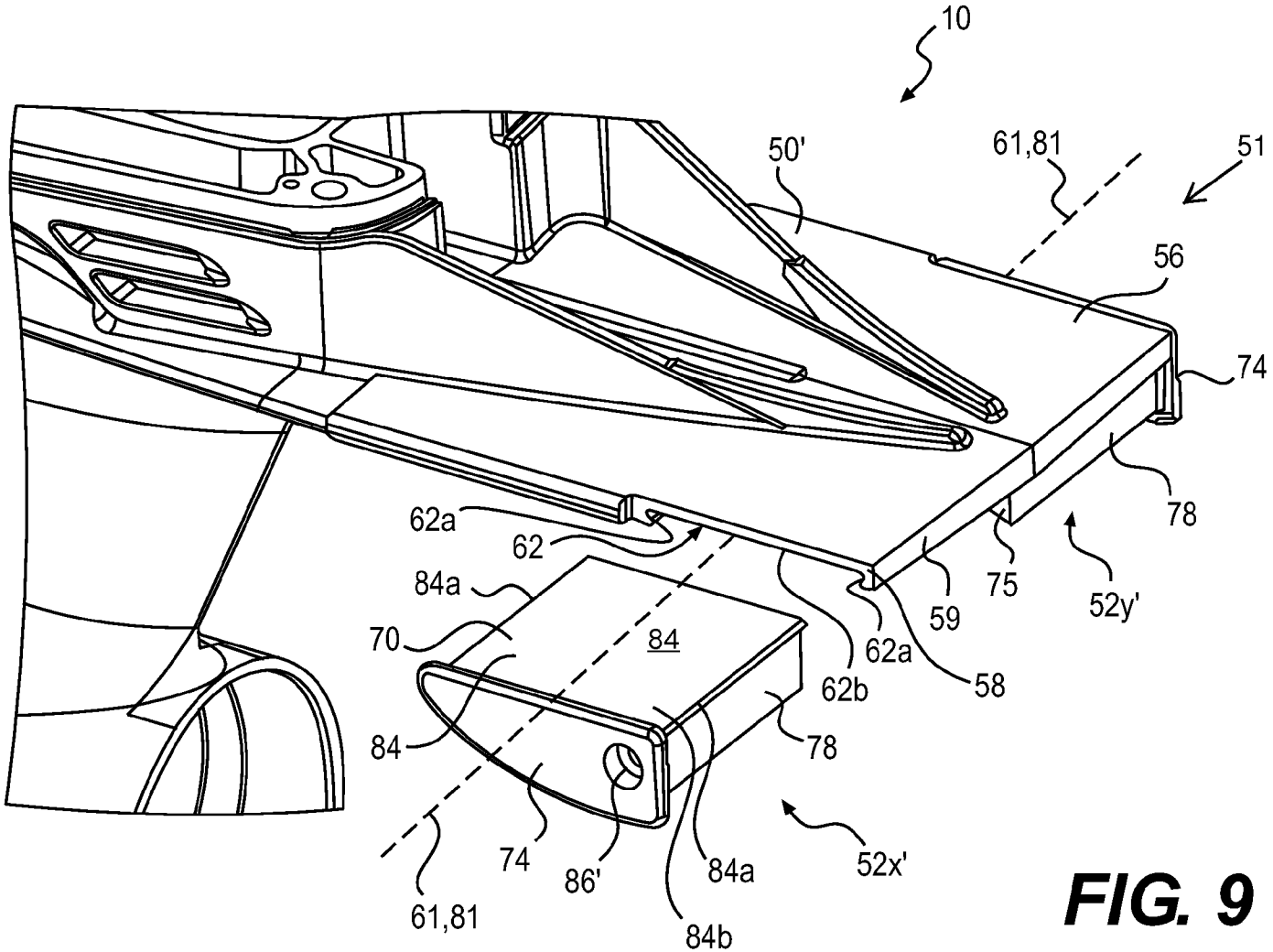
FIG. 9 is a perspective, taken from a top, rear and left side of the rear portion of the marine outboard engine of FIG. 7, showing the left foil portion removed from the AV plate and the right foil portion installed thereon.
Figure 10:
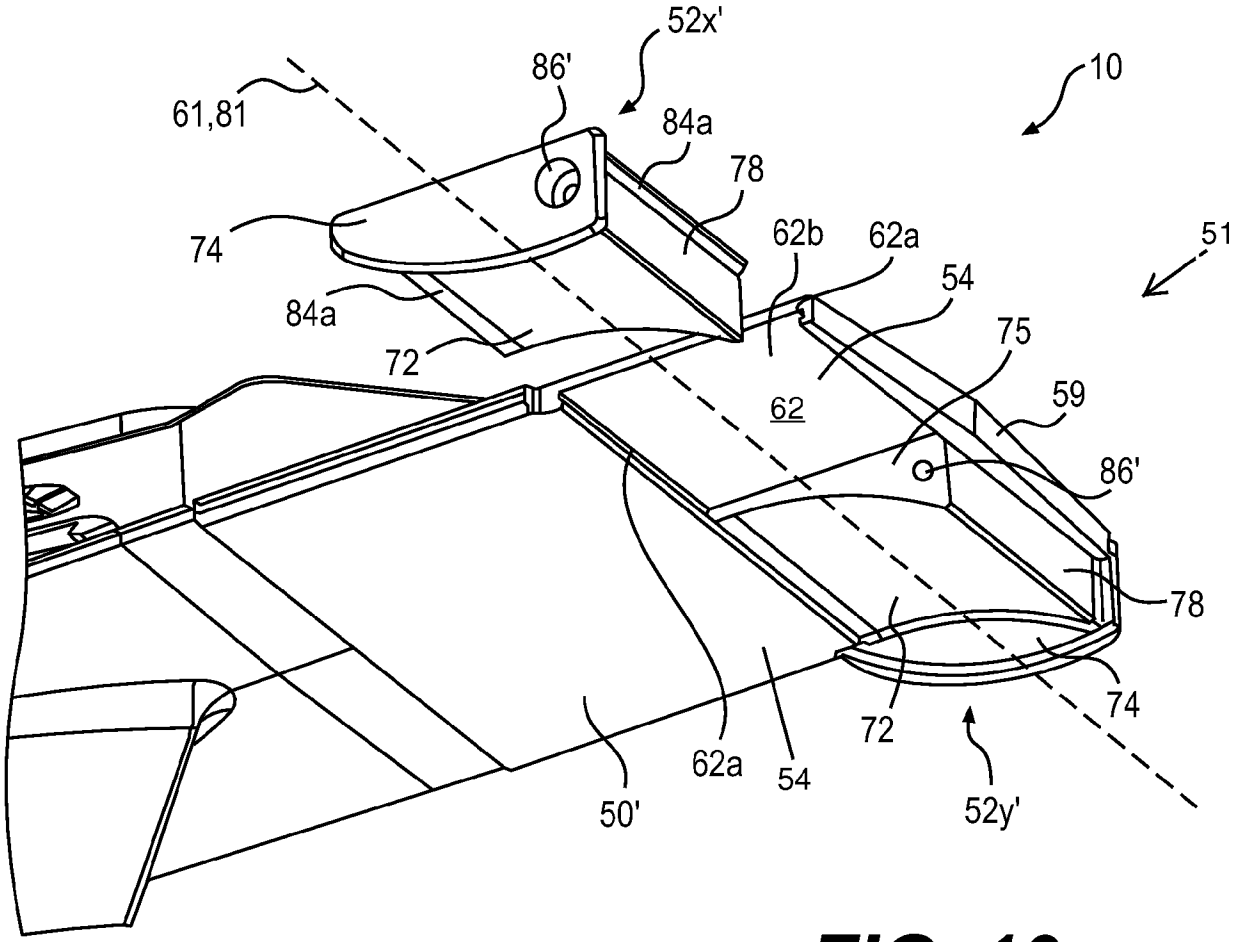
FIG. 10 is a perspective, taken from a bottom, rear and left side of the rear portion of the marine outboard engine of FIG. 9.
Figure 11:
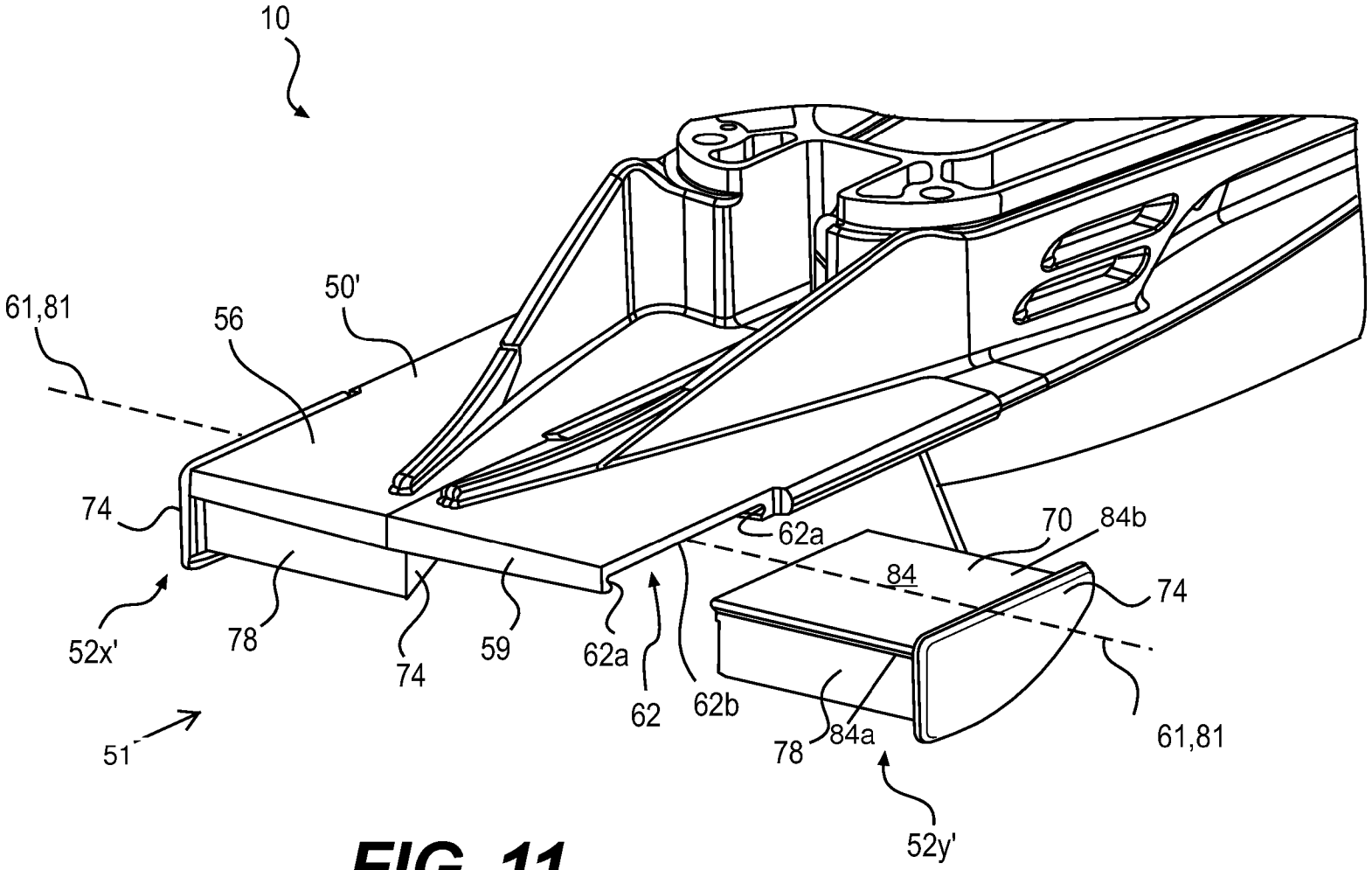
FIG. 11 is a perspective, taken from a top, rear and right side of the rear portion of the marine outboard engine of FIG. 7, showing the right foil portion removed from the AV plate and the left foil portion installed thereon.

With reference to FIGS. 4 and 5, the lower surface 54 includes two and a half channels 62 extending laterally along the lower surface 54. Each channel 62 extending into the AV plate 50 from its lower surface 54. It is contemplated that the number of channels 62 could be different as long as the there is at least one.

The channels 62 define a dovetail joint axis 61 (for the AV plate 50). The dovetail joint axis 61 of the AV plate 50, extending laterally across the AV plate 50, is therefore also perpendicular to a plane containing the rotation axis 47 of the propeller 20, which is aligned along the longitudinal direction of the engine 10 and the driveshaft axis 44*a*. It is contemplated that the channels 62 could be formed to extend longitudinally such that the dovetail joint axis 61 extends parallel to the propeller axis 47.

The channels 62 have trapezoidal shapes (tail-shaped). Each of the complete channels 62 is defined by a pair of opposing side walls 62*a* and an upper wall 62*b* joining the two walls 62*a*. The rearward-most channel 62 (i.e. the channel 62 farthest from the gearcase 40) extending at the rear face 59 of the AV plate 50, however, is a partial channel 62 having only one of the side walls 62*a* connected to the upper wall 62*b*.

The side walls 62*a* extend into the AV plate 50 from the lower surface 54 towards the upper surface 56 of the AV plate 50. The upper wall 62*b* extends horizontally between the side walls 62*a*. The side walls 62*a* extend at an acute angle with respect to the adjacent lower surface 54. The opposing side walls 62*a* of each channel 62 extend away from each other as they extend towards the upper wall 62*b* and the upper surface 56 of the AV plate 50. Thus, each channel 62 is formed such that the portion of the lower surface 54 of the AV plate 50 longitudinally adjacent to the channel 62 overhangs a portion of the channel 62.

It is, however, also contemplated that the shape and dimensions of the channels 62 could be different. For example, the side walls 62*a* could extend at a different acute angle with respect to the adjacent lower surface 54. The channels 62 could also have a rounded shape, with the opposing side channel walls 62*a* and/or the upper wall 62*b* forming a portion of an ellipse or a circle. The channels 62 could also be T-shaped channels where the portion of the side walls 62*a* extending from the lower surface 54 are approximately normal thereto, and then flare away from each other near the upper wall 62*b*. It is also contemplated that the distance along the lower surface 54 between adjacent channels 62 could be different.

In the illustrated embodiment, the channels 62 are identical to one another. It is however contemplated that the channels 62 could not be identical to each other, for example, some of the channels 62, side walls 62*a* and/or upper wall 62*b* could have a different size and/or shape compared to the others. The asymmetry of a surface having non-identical channels 62 could be useful, for example, to ensure that an accessory could only be inserted in a certain orientation.

In the embodiment shown, the channels 62 extend across the entire width of the AV plate 50, from one lateral face 58 to the other. It is contemplated that the channels 62 could extend from only a first one of the lateral faces 58. In this case, the accessory would have to be received in the channel 62 from that lateral face 58. The end of the channel 62 (formed by a surface generally normal to the joint axis 61), would act as a stop preventing the accessory from sliding out of the channel 62 near the other lateral face 58.

In the embodiment shown, the channels 62 have a uniform cross-section in the plane normal to the joint axis 61. It is also contemplated that the channels 62 could be tapering channels 62 with a decreasing cross-section in the plane normal to the joint axis 61. For example, the distance between opposing side channel walls 62*a* of each channel 62 could decrease as the channel 62 extends away from a first one of the lateral faces 58 towards the other to form channels 62 of tapering width. It is also contemplated that the vertical dimension (i.e. normal to the surface 62*b*) of the channel 62 could decrease as the channel 62 extends away from the first lateral face 58 towards the second lateral face 58 so as to form a tapering channel 62 of tapering height. In this case, the accessory would have to be received in the channel 62 from that first lateral face 58 towards the other lateral face 58. The narrower cross-sectional portion, of the channel 62 would act as a stop preventing the accessory from sliding out of the channel 62. It is further contemplated that the AV plate 50 could have tapering channels 62 extending away from each of the two lateral faces 58 toward the opposite lateral face 58. In this case, an accessory (or accessory portion) could be received in the channel 62 from each lateral face 58 and slid towards the opposite lateral face 58 as will be described further below.

Three fastener apertures 66 extend into the AV plate 50 from each of its lateral face 58. The fastener apertures 66 extend parallel to the dovetail joint axis 61. The fastener apertures 66 are threaded, and a bolt 67 is received in each of the apertures 66 to fasten the hydrodynamic foil 52 to the AV plate 50 as will be described below. It is also contemplated that the fastener apertures 66 could be through-holes extending from the left lateral face 58 to the right lateral face 58, and the bolt 67 received in the through-holes 66 is retained therein by a corresponding nut.

The AV plate is made of aluminum and cast as part of the gearcase 40. The channels 62 are formed on the AV plate 50 by being cast together with the gearcase 40. Thus the mold for fabrication of the gearcase 40 includes the AV plate 50 and the joint elements (channels 62 and/or protrusions 84) formed thereon. It is contemplated that the channels 62 could also be machined onto an AV plate 50 after it is already manufactured by any appropriate manufacturing process.

The hydrodynamic foil 52 includes a left foil portion 52*x* and a right foil portion 52*y*. The left and right foil portions 52*x*, 52*y* are respectively attached to a left and right portion of the lower surface 54 of the AV plate 50.

Each foil portion 52*x*, 52*y* includes an upper surface 70, the lower surface 72, an outer lateral face 74, an inner lateral face 75, a front face 76 and a rear face 78. The left and right foil portions 52*x*, 52*y* abut along their inner lateral faces 75 forming a continuous lower surface 72 which itself is continuous with the lower surface 54 of the AV plate 50. The lower surface 72 curves downwards towards the rear end 78. It is contemplated that the lower surface 72 could be discontinuous. It is also contemplated that the foil portion 52*x*, 52*y* could not join to form a continuous lower and/or upper surface 72, 70.

Each upper surface 70 has protrusions 84 formed thereon. Therefore, the joint surface for each foil portion 52*x*, 52*y* is the upper surface 70, and the accessory joint elements on the accessory joint surface are the protrusions 84. The left and right foil portions 52*x*, 52*y* abut along their inner lateral faces 75 to form continuous protrusions 84 across the inner lateral faces 75. The left and right foil portions 52*x*, 52*y* also form a continuous front face 76 and a continuous rear face 78.

The outer lateral faces 74 and the inner lateral faces 75 are straight and disposed along the longitudinal direction of the engine 10 perpendicular to the dovetail joint axes 61, 81. It is contemplated that the lateral faces 74, 75 could not be straight. For example, the inner lateral faces 75 could be curved, have discontinuities or other features. The inner lateral faces 75 of the foil portions 52*x*, 52*y* could have complementary features so that the foil portions 52*x*, 52*y* are complementary to one another in addition to each having the protrusions 84 complementary to the channels 62 of the AV plate 50.

The outer lateral faces 74 extend longitudinally forward of the front face 76 and longitudinally rearward of the rear face 78. The outer lateral faces 74 also extend above the upper surface 70 and below the lower surface 72. It is contemplated that the outer lateral face 74 could not extend beyond the front and rear faces 76, 78 and/or the lower surface 72.

The left and right foil portions 52$x$, 52$y$ are minor images of one another. It is contemplated that the foil portions 52$x$, 52$y$ could not be mirror images of one another. It is contemplated that the foil 52 could be have more than two foil portions, or that the foil 52 could be formed as a single integral portion 52. It is also contemplated that the foil 52 could be divided so as to have adjacent front and rear portions that are adjacent to one another in a direction perpendicular to the dovetail joint axes 61, 81 (and in the longitudinal direction of the engine 10). It is contemplated that the rectangular foil 52 could be divided diagonally.

Figure 6:
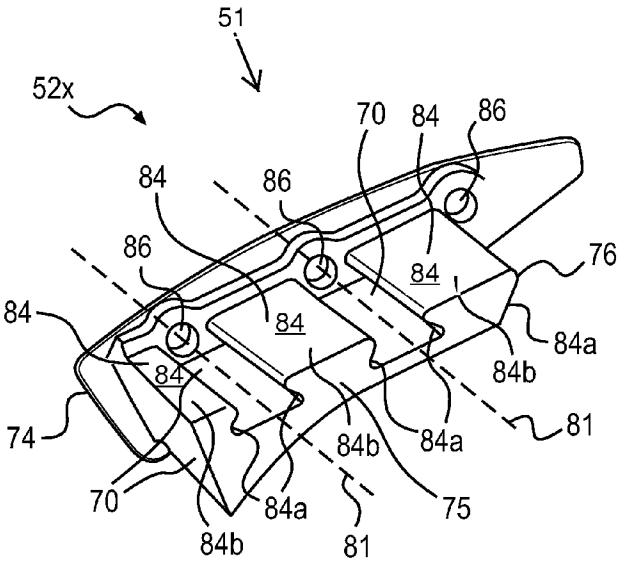
FIG. 6 is a perspective view, taken from a top, right side, of the left foil portion of FIG. 2, shown in isolation.

With reference to FIGS. 5 and 6, the foil 52 includes two and a half protrusions 84. The protrusions 84 of the foil portions 52$x$, 52$y$ are complementary to the channels 62 of the AV plate 50. It is contemplated that there could be a greater or fewer number of protrusions 82, 84 as long as the there is at least one foil protrusions 84 complementary to at least one of the plate channels 62.

The protrusions 84 of the foil portions 52$x$, 52$y$ extend laterally along the upper surface 70 between the lateral faces 74, 75. A central axis 82 of the protrusions defines the dovetail joint axis 81 of the foil 52. The joint axis 81 of the foil 52 therefore extends in the lateral direction along the foil portions 52$x$, 52$y$. In the embodiment shown, each protrusions 84 extends to each lateral face 74, 75, of each foil portion 52$x$, 52$y$ forming a continuous protrusion 84 across the foil 52. It is however contemplated that the protrusions 84 could extend to only one of the lateral faces 74, 75, or that the protrusions 84 could not extend to either lateral face 74, 75.

The protrusions 84 are thus also trapezoidal, and complementary in shape and dimensions to the channels 62 of the AV plate 50. Each protrusion 84 is defined by a pair of opposing side walls 84*a* extending upwards from the upper surface 70 and an upper wall 84*b* joining the two side walls 84*a*. The opposing side walls 84*a* of each protrusion 84 flare away from each other as they extend upwards from the upper surface 70 of the foil portions 52$x$, 52$y$ towards the upper wall 84*b*. For each protrusion 84, the side wall 82*a* extends at an acute angle with respect to the upper protrusion wall 84*b* extending between the pair of side walls 84*a*. The rearward-most protrusion 84 extending at the rear face 78 of the foil 52, however, is a partial protrusion 84 having only one of the side walls 84*a* connected to the upper wall 84*b*.

The foil portions 52$x$, 52$y$ are retained on the AV plate 50, at least in the longitudinal and vertical directions, by the dovetail joint formed by interlocking the channels 62 (tails) of the AV plate 50 with the protrusions 84 (pins) of the foil 52. Each foil protrusion 84 is disposed within each AV plate channel 62 such that the upper protrusion wall 84*b* abuts the upper channel wall 62*b*, and the side protrusion walls 84*a* abut the side channel surfaces 62*a*. The complementary channels 62 and protrusions 84 are sized to create a friction fit so that there is no slack or looseness between the AV plate 50 and the foil portions 52$x$, 52$y$ thereby helping to minimizing displacement of the foil portions 52$x,y$ relative to the AV plate 50.

The dovetail joint prevents displacement of the foil portions 52$x$, 52$y$ in a direction normal to the AV plate 50 (i.e. in a vertical direction) and along the plate in a direction perpendicular to the dovetail joint axes 61, 81. The foil portions 52$x$, 52$y$ are additionally fastened to the AV plate 50 in order to prevent their displacement along the AV plate 50 in a direction parallel to the dovetail joint axes 61, 81, although it is contemplated that the friction fit could be sufficient to prevent such displacement.

Three fastener apertures 86 extend into the outer lateral face 74 of each foil portion 52$x$, 52$y$. Each fastener aperture 86 is a through-hole, extending through the outer lateral face 74 just above the upper surface 70 between adjacent foil protrusions 84. The three fastener apertures 86 are aligned with the three threaded fastener apertures 66 of the AV plate 50. Each of the left and right foil portions 52$x$, 52$y$ is fastened to the corresponding left or right side of the AV plate 50 by the bolt 67 received through the foil aperture 86 and into the corresponding AV plate aperture 66 of the corresponding left or right lateral face 58 of the AV plate 50.

It is contemplated that the fastener apertures 86 of the foil portions 52$x$, 52$y$ could extend from the outer lateral face 74 to the inner lateral face 75 through the foil protrusion 84. The fastener apertures 86 of the left and right foil portions 52$x$, 52$y$ could be aligned with each other to fasten the foil portions 52$x$, 52$y$ to each other, instead of the AV plate 50 (as in the embodiment of FIGS. 7 to 11 which is discussed below).

It is contemplated that the bolt 67 (and therefore the apertures 66, 86) could extend at other angles with respect to the joint axes 61, 81. It is contemplated that fasteners other than the bolt 67 can be used to fasten the foil portions 52$x$, 52$y$ to each other and/or to the AV plate 50. Examples of fasteners that could be used include clips, spring-loaded pins, clamps, latches and the like.

The hydrodynamic foil 52 is made of molded plastic but it is contemplated that the foil 52 could be made of any suitable materials and by any appropriate process. The protrusions 84 are defined on the foil 52 during the molding of the foil 52, but the protrusions 84 could also be machines onto the foil 52 after the foil 52 has been molded.

The foil 52 is installed on the AV plate 50 as described below. The left foil portion 52$x$ is placed adjacent the AV plate 50 so that the inner lateral face 75 is adjacent the left lateral face 58 of the AV plate 50 with the AV plate channels 62 aligned with the foil protrusions 84. The left foil portion 52$x$ is pushed rightwards onto the AV plate 50 sliding the foil protrusions 84 along the plate channels 62, thereby forming the interlocking dovetail joint between the AV plate 50 and left foil portion 52$x$, until the left lateral face 58 prevents further rightward movement. The right foil portion 52$y$ is similarly placed adjacent the AV-plate 50 so that the inner lateral face 75 is adjacent the right lateral face 58 with the AV plate channels 62 aligned with the foil protrusions 84. The right foil portion 52$y$ is similarly pushed leftwards onto the AV plate 50 to slide the right foil portion protrusions 84 along the AV plate channels 62, thereby forming the interlocking dovetail joint between the AV plate 50 and right foil portion 52$y$, until the right lateral face 58 and the inner lateral face 75 face of the left foil portion 52$x$ prevent further leftward movement. A fastener 67 is then inserted through each foil aperture 86 into the corresponding aligned AV plate aperture 66 to lock the foil 52 to the AV plate 50.

The foil can conveniently be installed without requiring insertion of the operator's hands or tools between in the space between the AV plate and the bladed rotors of the propeller 20. Installation of the foil 52 may also be performed without requiring any tools by using appropriate fasteners.

As mentioned above, it is contemplated that the channels 62 of the AV plate 50 extends to only a first one of the lateral faces 58. The foil portions 52$x$, 52$y$ (or a single integral foil 52) would, in this case, be pushed onto the AV plate 50 from that first lateral face 58 towards the opposite lateral face 58 until the end of the foil protrusion 84 is blocked from being pushed any further by the end of the channel 62.

As mentioned above, it is contemplated that the channels and protrusions could have any complementary interlocking shapes so as to form an interlocking joint between the foil 52 and the AV plate 50.

As mentioned above, it is contemplated that the channels 62 of the AV plate 50 could be tapering channels 62 with a varying cross-sectional are in the plane normal to the joint axis 61. It should be understood that in the case of an AV plate 50 having tapering channels 62, the foil portions 52*x*, 52*y* (or the single integral foil 52) would have corresponding complementary tapering protrusions 84 wherein the cross-sectional area of the protrusions 84 in the plane normal to the joint axis 81 varies from one of the lateral faces 74, 75 toward the other of the lateral faces 74, 75. The tapering protrusions 84 could be formed with the separation between the side protrusion walls 84*a* of a protrusion 84 decreasing from one of the lateral faces 74, 75 toward the other of the lateral faces 74, 75. It is also contemplated that the vertical dimension of the protrusion 84 (i.e. normal to the surface 84*b*) could decrease from one of the lateral faces 74, 75 toward the other of the lateral faces 74, 75 to form the tapering protrusion. It should be understood that in the case of a foil 52 having separate foil portions 52*x*, 52*y* as in the illustrated embodiment, the direction of tapering of the tapering protrusions 84 of each foil portion 52*x*, 52*y* would depend on whether the channels 62 on the AV-plate taper from one of the lateral faces 58 towards the other, or from each of the lateral faces 58 towards the other. The foil portions 52*x*, 52*y* would be minor images if the channels 62 on the AV-plate taper continuously from one of the lateral faces 58 towards the other lateral face 58. The foil portions 52*x*, 52*y* would be neither mirror images nor identical, if the channels 62 on the AV-plate taper from each of the lateral faces 58 towards the other lateral face 58.

It will be appreciated that, in the above discussion of the embodiments of the AV plate 50 and complementary foil 52, the joint elements on each of their respective joint surfaces 54, 70 could be equally well described channels and/or protrusions.

For example, with reference to the AV plate 50, by defining the surface 62*b* (currently defined as a channel wall) as the lower surface of the AV plate 50, the joint elements of the AV plate 50 could be described as protrusions formed by the side walls 62*a* and the surface 54 extending between side walls 62*a*.

Furthermore, the joint elements of AV plate 50 could even be described as alternating channels and protrusions, abutting one another with no spaced therebetween. In this case, the surface 54 between side walls 62*a* would be a protrusion wall extending between side walls 62*a*, while the surface 64*b* would be the channel wall as before.

Whichever description/definition is selected, the joint elements of the AV plate 50 are complementary to the joint elements of the foil 52, and form an interlocking joint between respective joint surfaces (i.e. the lower surface 54 of the AV plate 50 and the upper surface 70 of the foil 52).

It is contemplated that protrusions 84 and/or channels 62 could also be formed on the upper surface 56 of the AV plate 50. It is contemplated that a plurality of accessories could be attached to the AV plate 50 via the upper and lower surfaces 56, 54. It is also contemplated that a foil 52 could be attached to the upper surface 56 of the AV plate 50. In this case, the foil 52 could have an upper portion extending above the upper surface 56 of the AV plate 50 and a lower portion extending below the lower surface of the AV plate 50. The foil 52 could be retained to the AV plate 50 by a dovetail joint formed between the upper portion of the foil 52 and the upper surface 56, while the lower surface of the lower portion forms a curved surface to provide lift to the boat.

It will be appreciated that other types of accessories 52, such as hydrofoil wings and trolling plates, could be attached using the attachment system 51 described above.

It is contemplated that a plurality of different foils 52 could be provided, with each foil having a different curved and/or angled surface, and thereby adapted for a different hydrodynamic effect. The foil 52 appropriate for the particular watercraft, outboard engine 10, and riding conditions, could then be selected for installation on the AV plate 50 from the plurality of foils 52 provided.

With reference now to FIGS. 7 to 11, an AV plate 50' and a foil 52' according to another embodiment will be discussed. Corresponding features of the AV plate 50' and foil 52', and the AV plate 50 and foil 52 of the embodiment of FIGS. 2 to 6 that are similar have been labeled with the same reference number, and will not be discussed again in detail. Corresponding but different features have been denoted by using the same reference label and an apostrophe thereafter.

The lower surface 54 of the AV plate 50' has a single channel 62. The channel 62 forms a slot extending across the rear portion of the AV plate 50' from the left lateral 58 to the right lateral face 58. The channel 62 extends in the lateral direction of the AV plate 50' and defines the joint axis.

The foil 52' comprises left and right foil portions 52*x'*, 52*y'*. Each of the foil portions 52*x'*, 52*y'* forms a single protrusion 84, complementary to the channel 62 of the AV plate 50'. The single protrusion 84 extends over the entire upper surface 70 of the foil portions 52*x'*, 52*y'*. Side protrusion walls 84*a* extend from the upper wall 84*b* of the protrusion 84 to the front and rear faces 76, 78.

The protrusion 84 extends in the lateral direction of the foil 52' and defines the axis 81. The protrusion 84 is received in the channel 62 to form a dovetail joint between the AV plate 50' and the foil 52' and thereby retaining the foil 52' against the lower surface 56 of the AV plate 50', at least in the longitudinal and vertical directions.

A fastener aperture 86' extends laterally in each of the foil portions 52*x'*, 52*y'* parallel to the axes 81, 61. The fastener apertures 86' extends just forward of the rear end 78 of the foil portions 52*x'*, 52*y'* where the curved lower surface 72 is spaced farthest from the upper surface 70. The fastener aperture 86' of the left foil portion 52*x'* is a non-threaded through-hole extending from the outer lateral face 74 to the inner lateral face 75. The fastener aperture 86' of the right foil portion 52*y'* is a threaded hole, but not a through-hole, and extends from the inner lateral face 75 towards the outer lateral face 74. A bolt 67 is extended through the left fastener apertures 86' of the left portion 52*x'* into the right threaded fastener aperture 86' of the right portion 52*y'* to fasten the left and right foil portions 52*x'*, 52*y'* to each other and to thereby prevent them from moving in the lateral direction with respect to each other and the AV plate 50'.

It is contemplated that the apertures 86' of both foil portions 52'*x*, 52*y'* could be through-holes, and a nut could be used to retain the bolt extended through the apertures 86' and fasten the foil portions 52'*x*, 52*y'* together.

It is also contemplated that the engine 10 could have a plate, other than the AV plate 50, extending outwards from the cowling 38. The protrusions 84 and/or channels 62 could be formed on the plate for attachment of accessories thereto as described above.

Figure 12A:
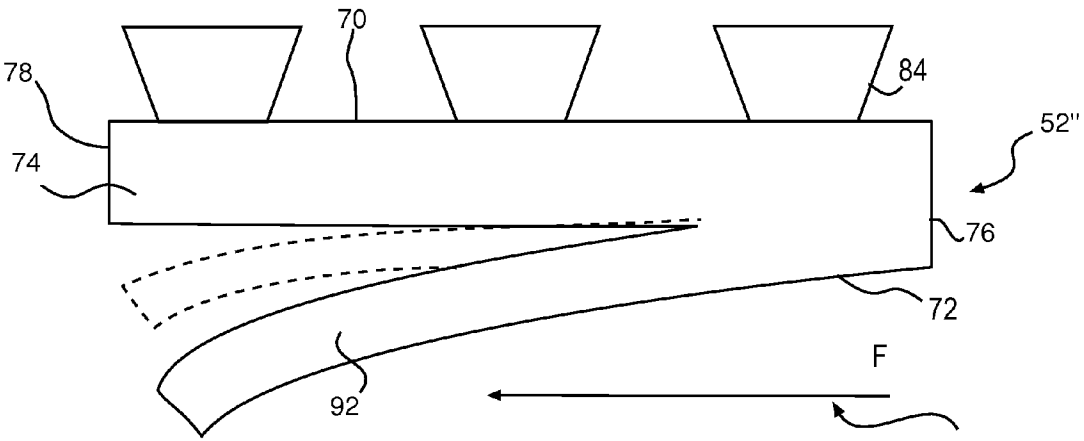
FIG. 12A is a schematic right side elevation view of a foil having a moveable lower surface.
Figure 12B:
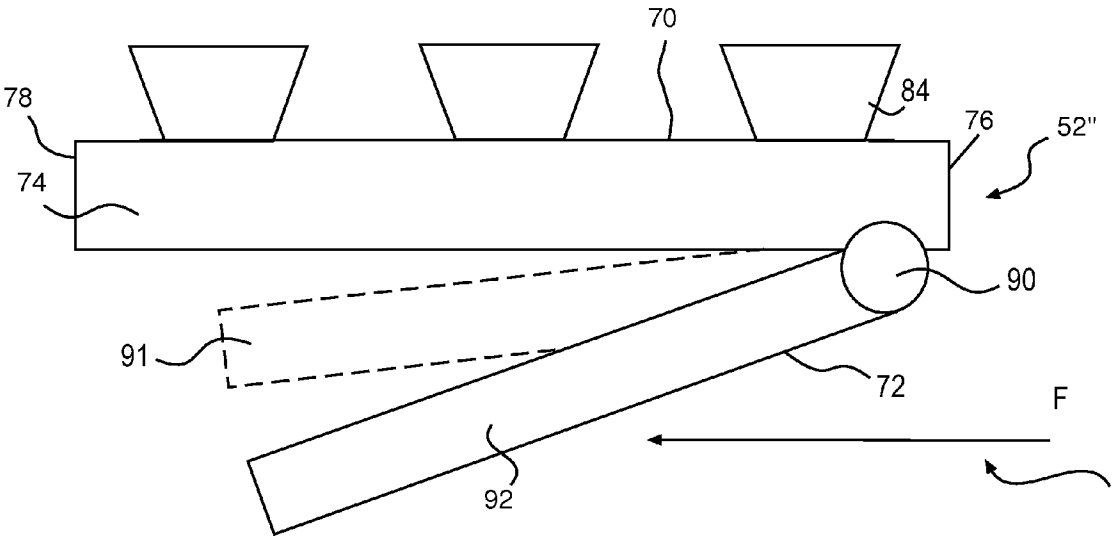
FIG. 12B is a schematic right side elevation view of another embodiment of a foil having a moveable lower surface.

It is contemplated that the hydrodynamic features of the foil 52", such as the curved surface 72, could not be rigid. For example, it may be advantageous for the angle and/or curvature of the curved surface 72 to diminish at high speeds and/or other operating conditions. FIGS. 12A and 12B illustrate embodiments of the foil 52" in which the lower surface 72 is disposed on a lower portion 92 that is moveable with respect to the AV plate 50. The upper surface 70 of the foil 52" is rigidly connected to the AV plate 50 as described above.

In the foil 52" of FIG. 12A, the lower portion 92 is elastically deformable and bends upwards, as shown in dotted lines, in response to increasing hydrodynamic force exerted thereon by the water. Therefore, the curvature of the lower surface 72, and consequently both the amount of lift and drag generated by the foil 52", can change in response to the hydrodynamic force exerted thereon. It is contemplated that only a portion of the lower surface 72, or a feature thereof, could be elastically deformable and moveable in response to the hydrodynamic force exerted thereon by the water.

In the foil 52" of FIG. 12B, the lower portion 92 is formed as a hinged plate and spring system. The lower portion 92 is connected to the upper portion of the foil 52" having the upper surface 70 by a hinge 90 and a spring 91. The upper surface 70 is rigidly connected to the AV plate 50. The hinge 90 allows the angle of the lower surface 72 with respect to the upper surface 70 to vary. The spring 91 provides a balancing force on the lower surface 72 against the hydrodynamic force, thereby modulating the response of the lower surface 70 to the hydrodynamic force. It is contemplated that the spring 91 could be omitted, and the lower surface 70 could be moved manually to a desired angle with respect to the upper surface 70 and retained therein by appropriate fastening means. It is also contemplated that an actuator could be used to move the lower portion 92 of the foil 52".

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A drive unit, comprising:

an engine;

a driveshaft having a first end and a second end, the first end of the driveshaft being operatively connected to the engine;

a transmission being operatively connected to the second end of the driveshaft;

a gearcase;

a propeller shaft disposed at least in part in the gear case at an angle to the driveshaft, the propeller shaft being operatively connected to the transmission;

a bladed rotor connected to the propeller shaft and extending outside the gear case; and a plate extending above the rotor, the plate being adapted to slidingly receive an accessory along a joint axis, the accessory having an accessory joint element, the accessory joint element being one of a channel and a protrusion, the plate comprising:

a first surface facing away from the rotor;

a second surface facing toward the rotor, one of the first and second surfaces being a plate joint surface; and a plate joint element being the other of the channel and the protrusion, the plate joint element extending along the plate joint surface parallel to the joint axis, the plate joint element being adapted to slidingly interlock with the accessory joint element to thereby prevent displacement of the accessory joint element in a first direction parallel to the plate joint surface and perpendicular to the joint axis, and in a second direction normal to the plate joint surface.

2. The drive unit of claim 1, wherein the joint axis is normal to a plane containing the rotational axis of the rotor and the driveshaft.

3. The drive unit of claim 1, wherein the joint surface is the second surface facing toward the rotor.

4. The drive unit of claim 1, wherein the plate comprises:

a rear edge disposed opposite the one of the midsection and the gear case;

a first lateral edge and a second lateral edge, each lateral edge extending between the rear edge and the one of the midsection and the gear case; and wherein the plate joint element extends from the first lateral edge to the second lateral edge.

5. The drive unit of claim 1, wherein the plate joint element comprises at least one channel extending into the plate from the joint surface, each of the at least one channel is defined by a pair of opposing side walls and a base connecting the opposing side walls;

each of the opposing side walls extends from the joint surface, at an acute angle with respect thereto, towards the channel base.

6. The drive unit of claim 1, wherein the plate includes a fastener aperture having a fastener axis parallel to the joint axis, the fastener aperture being adapted to receive a fastener to prevent displacement of the accessory joint surface in the direction parallel to the joint axis when the accessory is slidably received on the plate.

7. The drive unit of claim 1, further comprising:

an accessory having an accessory joint surface comprising the accessory joint element, the accessory joint element being interlocked with the plate joint element; and a fastener fastening the accessory to the plate and thereby preventing displacement of the accessory joint element in the direction parallel to the joint axis.

8. The drive unit of claim 7, wherein the fastener is one of a screw and a bolt, the one of the screw and the bolt extending parallel to the joint axis.

9. The drive unit of claim 7, wherein the accessory further comprises an accessory surface generally facing the rotor and extending at a lift angle with respect to the plate joint surface to generate lift when submerged in water.

10. The drive unit of claim 9, wherein the accessory surface is curved.

11. The drive unit of claim 9, wherein the lift angle of the accessory surface is adjustable.

12. The drive unit of claim 11, wherein the accessory further comprises a hinge, the accessory surface being disposed in a portion of the accessory pivotably connected, by the hinge, to a portion of the accessory having the accessory joint surface, the lift angle of the accessory surface being thereby adjustable.

13. The drive unit of claim 11, wherein the accessory further comprises an actuator, the accessory surface being disposed in a portion of the accessory connected to the actuator, the lift angle of the accessory surface being thereby adjustable by the actuator.

14. The drive unit of claim 11, wherein the lift angle of the accessory surface is adjustable in response to the hydrodynamic force of the water.

15. The drive unit of claim 14, wherein the accessory is elastically deformable so as to adjust the lift angle in response to the hydrodynamic force of the water.

16. The drive unit of claim 14, wherein the accessory further comprises a spring, the accessory surface being disposed in a portion of the accessory connected to a portion of the accessory having the accessory joint surface via the spring, the spring being compressible in response to the hydrodynamic force of the water to thereby adjust the lift angle in response to the hydrodynamic force of the water.

17. The drive unit of claim 1, wherein the plate joint element is a plurality of the one of the channel and the protrusion.

18. The drive unit of claim 17, wherein the accessory comprises an accessory body defined by a first accessory portion and a second accessory portion, wherein:

the first accessory portion is adjacent to the second accessory portion, and each of the first and second accessory portions comprises at least a portion of the accessory joint element interlocked with the plate joint element.

19. The drive unit of claim 18, wherein the first and second accessory portions are each adapted to be slidingly received on the plate from opposite directions parallel to the joint axis.

20. The drive unit of claim 18, wherein:

the accessory body comprises an accessory surface generally facing the rotor;

the accessory surface is continuous across a boundary between the adjacent first and second accessory portions; and the accessory surface extends at a lift angle with respect to the accessory joint surface to generate lift.

21. The drive unit of claim 18, wherein the fastener extends from one of the first accessory portion and the second accessory portion to the other of the first accessory portion and the second accessory portion to prevent displacement of the accessory joint.

22. The drive unit of claim 1 further comprising:

a cowling, the engine and the driveshaft being disposed in the cowling; and a midsection connected to the engine, the midsection having a first end and a second end, the gearcase being connected to the second end of the midsection, the plate extending from one of the midsection and the gearcase.

* * * * *